US009272283B2

(12) United States Patent
Ito et al.

(10) Patent No.: US 9,272,283 B2
(45) Date of Patent: Mar. 1, 2016

(54) BUCKET-TYPE JAW CRUSHER

(75) Inventors: Katsuhiro Ito, Tokyo (JP); Makoto Ishioka, Tokyo (JP); Mitoko Ishioka, legal representative, Kawachigun (JP); Rie Ishioka, legal representative, Kawachigun (JP); Narumi Ishioka, legal representative, Ootawarashi (JP)

(73) Assignee: ITOH CO., LTD., Tokyo (JP)

( * ) Notice: Subject to any disclaimer, the term of this patent is extended or adjusted under 35 U.S.C. 154(b) by 415 days.

(21) Appl. No.: 13/698,493

(22) PCT Filed: May 17, 2011

(86) PCT No.: PCT/JP2011/061349

§ 371 (c)(1),
(2), (4) Date: Nov. 16, 2012

(87) PCT Pub. No.: WO2011/145631

PCT Pub. Date: Nov. 24, 2011

(65) Prior Publication Data

US 2013/0153697 A1 Jun. 20, 2013

(30) Foreign Application Priority Data

May 18, 2010 (JP) ..... 2010-114823
May 18, 2010 (JP) ..... 2010-114824
Nov. 10, 2010 (WO) ..... PCT/JP2010/070058

(51) Int. Cl.
*B02C 1/00* (2006.01)
*B02C 1/02* (2006.01)
(Continued)

(52) U.S. Cl.
CPC . *B02C 1/02* (2013.01); *B02C 1/005* (2013.01); *B02C 1/025* (2013.01); *B02C 1/04* (2013.01);
(Continued)

(58) Field of Classification Search
CPC ..... B02C 1/02; B02C 1/04; B02C 1/06; B02C 1/10; B02C 25/00
USPC ..... 241/266, 101.73
See application file for complete search history.

(56) References Cited

U.S. PATENT DOCUMENTS 1,507,661 A 9/1924 Buchanan
2,449,746 A 9/1948 Kinkel
(Continued)

FOREIGN PATENT DOCUMENTS

DE 389045 A 1/1924
EP 0773065 A1 5/1997
(Continued)

OTHER PUBLICATIONS

International Search Report for PCT/JP2011/061349, mailing date of Aug. 2, 2011.
(Continued)

*Primary Examiner* — Faye Francis
(74) *Attorney, Agent, or Firm* — Westerman, Hattori, Daniels & Adrian, LLP

(57) ABSTRACT

The present invention relates to improvement to a bucket-type jaw crusher used for treatment of slag and other waste. In a bucket-type jaw crusher provided with a bucket (1) attached to an arm of a construction machine, a fixed jaw (5) fixed in the bucket, and a moving jaw (6) opposed to the fixed jaw (5) and pivotally supported on the top by an eccentric shaft (7) and supported on the bottom by a toggle mechanism and crushing slag and other materials to be crushed by reciprocating swing of the moving jaw (6), a motor (9) for rotating the eccentric shaft (7) forward and reverse is provided in the bucket and crushing control means is provided which automatically rotates the eccentric shaft (7) in reverse by the motor (9) and then, rotates the shaft forward when crushing the material to be crushed.

9 Claims, 11 Drawing Sheets

(51) Int. Cl.

| | |
|---|---|
| ***B02C 25/00*** | (2006.01) |
| ***B02C 1/04*** | (2006.01) |
| ***E02F 3/407*** | (2006.01) |
| ***E02F 3/96*** | (2006.01) |
| ***E02F 7/06*** | (2006.01) |
| ***E02F 9/22*** | (2006.01) |

(52) U.S. Cl.

CPC ..... *B02C 25/00* (2013.01); *E02F 3/407* (2013.01); *E02F 3/965* (2013.01); *E02F 7/06* (2013.01); *E02F 9/2221* (2013.01)

(56) References Cited

U.S. PATENT DOCUMENTS

| | | | | |
|---|---|---|---|---|
| 5,054,958 | A * | 10/1991 | Strunk | 404/75 |
| 5,630,555 | A * | 5/1997 | Boyd | 241/29 |
| 7,980,501 | B2 * | 7/2011 | Ueda | 241/268 |
| 2004/0050986 | A1 * | 3/2004 | Rossi, Jr. | 241/101.73 |
| 2005/0082403 | A1 * | 4/2005 | Boast | 241/266 |
| 2010/0206975 | A1 | 8/2010 | Ueda | |

FOREIGN PATENT DOCUMENTS

| | | | |
|---|---|---|---|
| EP | 0773067 | A1 | 5/1997 |
| FR | 776752 | A | 2/1935 |
| FR | 1512467 | A | 2/1968 |
| JP | 48-90253 | U | 10/1973 |
| JP | 59-16125 | Y2 | 5/1984 |
| JP | 62-199136 | U | 12/1987 |
| JP | 6-91182 | A | 4/1994 |
| JP | 8-150344 | A | 6/1996 |
| JP | 3025742 | U | 6/1996 |
| JP | 9-24282 | A | 1/1997 |
| JP | 9-187668 | A | 7/1997 |
| JP | 2003-53681 | A | 2/2003 |
| JP | 2005-74395 | A | 3/2005 |
| JP | 2009-45529 | A | 3/2009 |
| JP | 2009-56423 | A | 3/2009 |
| JP | 2010-64008 | A | 3/2010 |
| JP | 3164735 | U | 12/2010 |
| JP | 3165577 | U | 1/2011 |

OTHER PUBLICATIONS

International Search Report for PCT/JP2010/070058, mailing date of Dec. 14, 2010.

* cited by examiner (a)

(b)

(a)

(b)

(a)

(b)

(a)

(b)

(a)

(b)

BUCKET-TYPE JAW CRUSHER

TECHNICAL FIELD

The present invention relates to improvement to a bucket-type jaw crusher used in treatment of slag and other waste.

BACKGROUND ART

As a prior-art bucket-type jaw crusher attached to an arm of a work machine such as a hydraulic excavator and the like, a bucket for crushing and selecting stones in Japanese Patent Laid-Open No. 2009-45529 (Patent Literature 1), for example, discloses a bucket structure provided with an inlet opening portion and an outlet opening portion for a material such as stones, a shovel-shaped main body regulating a flow direction of the material such as the stones between this inlet opening portion and the outlet opening portion, first and second jaws attached in this main body and opposed to each other, moving means having an eccentric connection portion between a member rotationally moving around a rotation axis and the first jaw so as to give first rotational movement and translational movement of the first jaw around the rotation axis in relation at least with the first jaw by bringing the first jaw close to or separating the same away from the second jaw in order to crush the material such as the stones flowing through these jaws, and a toggle connection portion between the main body and the first jaw in order to give second rotational movement and translational movement of the first jaw, in which this toggle connection portion has a support column pivotally supported by the first jaw and the main body so as to rotationally move around the respective pivotal support axis, this support column extends between the first jaw and the main body so that a line segment connecting the both pivotal support axes inclines by an angle larger than 90° with respect to a line segment connecting the pivotal support axis between the support column and the first jaw and the rotational axis, and this bucket includes a lower part in which a cell-shaped structural body is formed and a reinforcing plate attached to the respective side portions of the main body.

Moreover, a bucket-type jaw crusher in Japanese Patent Laid-Open No. 2009-56423 (Patent Literature 2) discloses a structure of a bucket-type jaw crusher to be attached to an arm of a hydraulic excavator in which a fixed jaw is provided on an inner surface on the bottom of the bucket, an upper part is pivotally supported by an eccentric main spindle driven by a hydraulic motor opposite to that, a lower part is supported by a toggle plate, and a material to be crushed can be crushed by a moving jaw in inverted triangular arrangement, in which, in an intermediate portion between the hydraulic motor on one side of the eccentric main spindle and a flywheel on the other side, a counterweight is provided so as to adjust the balance, and while the moving jaw is reciprocally moved so as to press down the material to be crushed from the upper part to the lower part by means of rotation of the eccentric main spindle, the toggle plate is attached to an up grade ahead and the material to be crushed is pressed onto the fixed jaw so that strong and fine crushing can be performed.

In these types of the bucket-type jaw crusher, an eccentric shaft is provided on a shaft portion supporting the moving jaw and this is rotated, and thus, a motion trajectory of the surface of the moving jaw and a jaw plate is close to a circular motion in the vicinity of the eccentric shaft but changes from an oval motion to an arc motion as it gets closer to a toggle support portion on the discharge side, draws in the material to be crushed to the discharge side by rotating the eccentric shaft in the forward direction and pushes it up to the scooping side by rotation in the reverse direction.

Therefore, in a normal crushing work, only forward rotation is made and not in the reverse direction, and only if the material to be crushed is caught by the jaw crusher, the machine is stopped once, the opening of the bucket is displaced downward, and the crusher is rotated in the reverse direction so as to discharge the caught material to be crushed.

In the bucket-type jaw crusher, since the work of scooping up the material to be crushed and crushing it by the bucket and discharging it is repeated, it is necessary to repeat start and stop of the jaw crusher frequently.

In a stationary jaw crusher (compression-type crusher), the jaw crusher is started from a non-load state, while in the case of the bucket-type jaw crusher, it is started in a loaded state in which the material to be crushed is scooped in the bucket as described above.

Thus, when a hard material to be crushed is to be treated, if start-up of the jaw crusher is to be started in a state where the material to be crushed is caught by directing the opening of the bucket upward, the material to be crushed is bitten, and start-up might become impossible.

Thus, in the prior-art bucket crusher, by starting start-up of the jaw crusher in a state where the bucket is in an inclined posture in the middle of the course from scooping the material to be crushed by the bucket to moving with the opening of the bucket completely upward, a degree of being caught of the material to be crushed at the upward crush position is reduced in the crushing treatment, but an operator needs to adjust timing of start-up in accordance with hardness and size of the material to be crushed, and if the timing is wrong, the material to be crushed is caught and the start-up of the jaw crusher might become impossible.

Moreover, since bucket-type jaw crusher in Patent Literature 2 is configured such that the hydraulic motor is directly connected to one side of the eccentric main spindle, the eccentric main spindle becomes an output shaft of the hydraulic motor, and an impact generated when a foreign substance is bitten is directly transmitted to the hydraulic motor. Thus, if a hard metal material or the like contained in the slag during the crushing treatment of the slag is bitten, for example, there is a risk of giving an extremely large impact load to the hydraulic motor, and the machine cannot be applied to the slag treatment.

Furthermore, in the bucket-type crusher, in order to handle weight limitation, the weight reduction of the moving jaw is promoted, but since a tip end of the jaw plate of the moving jaw is hooked by a hook-shaped hook portion formed integrally on a base portion of the moving jaw, if elongation is generated in the jaw plate made of manganese, it cannot be absorbed but a crack or damage occurs in the hook portion, which causes nonconformity that repair of the entire base portion is required.

CITATION LIST

Patent Literature

Patent Literature 1: Japanese Patent Laid-Open No. 2009-45529

Patent Literature 2: Japanese Patent Laid-Open No. 2009-56423

SUMMARY OF THE INVENTION

Problems to be Solved by the Invention

The present invention was made in view of the above circumstances and has an object to provide a bucket-type jaw crusher which can reliably crush a material to be crushed even if the material to be crushed scooped is caught without a gap in a bucket.

Another object of the present invention is to provide a toggle mechanism with high reliability which does not give a biased load on a tension spring with a continuous smooth motion without requiring supply of a lubricant oil by minimizing a contact face between a toggle plate and a toggle seat.

Still another object of the present invention is to provide a bucket-type jaw crusher which can absorb elongation of a jaw plate of a moving jaw by adjusting tension of a securing tool and is provided with a jaw-plate fixing claw portion which can be easily replaced.

Solution to the Problems

In order to solve the above-described problems, the present invention is characterized in that, in a bucket-type jaw crusher provided with a bucket attached to an arm of a construction machine, a fixed jaw fixed in the bucket, and a moving jaw opposed to the fixed jaw and pivotally supported on the top by an eccentric shaft and supported on the bottom by a toggle mechanism, the fixed jaw and the moving jaw being arranged such that a space on a scooping side of the bucket is opened wide as an inlet and is gradually narrowed toward the depth and continues to an outlet of the bucket, for crushing slag and other materials to be crushed by swing of the moving jaw, a motor for rotating the eccentric shaft forward and reverse is provided in the bucket and crushing control means is provided which automatically rotates the eccentric shaft in reverse by the motor and then, rotates the shaft forward when crushing the material to be crushed.

Advantages of the Invention

In the bucket-type jaw crusher of the present invention, even if the material to be crushed is scooped in the bucket and caught without a gap between the fixed jaw and the moving jaw in the crushing treatment, since the eccentric shaft of the moving jaw is first rotated in reverse and then, rotated forward and the crushing is started, a gap is generated between the material to be crushed between the moving jaw and the fixed jaw, and crushing can be performed efficiently without biting.

As a result, a scooped amount of the bucket can be increased.

Moreover, the toggle mechanism can continuously and smoothly perform displacement of the toggle plate with movement of the moving jaw by minimizing contact between the toggle plate and the toggle seat, and an eccentric load is not applied to a tension spring, which raises reliability.

By providing a dust-proof cover on upper and lower parts, the toggle mechanism is not affected by dusts even if the bucket-type jaw crusher is stood upside down.

Moreover, by providing a separate-body jaw-plate fixed claw portion for constraining the jaw plate with respect to elongation of the jaw plate of the moving jaw, elongation can be absorbed by adjusting the tension of the securing tool such as a bolt of the jaw-plate fixing claw portion, and the jaw-plate fixing claw portion itself can be replaced easily.

Furthermore, by providing a liner plate made of a substantially triangular abrasion-resistant steel plate inside right and left side plates of a crusher portion, abrasion on a wall surface in the bucket is prevented, and durability can be improved.

BEST MODE FOR CARRYING OUT THE INVENTION

Figure 1:
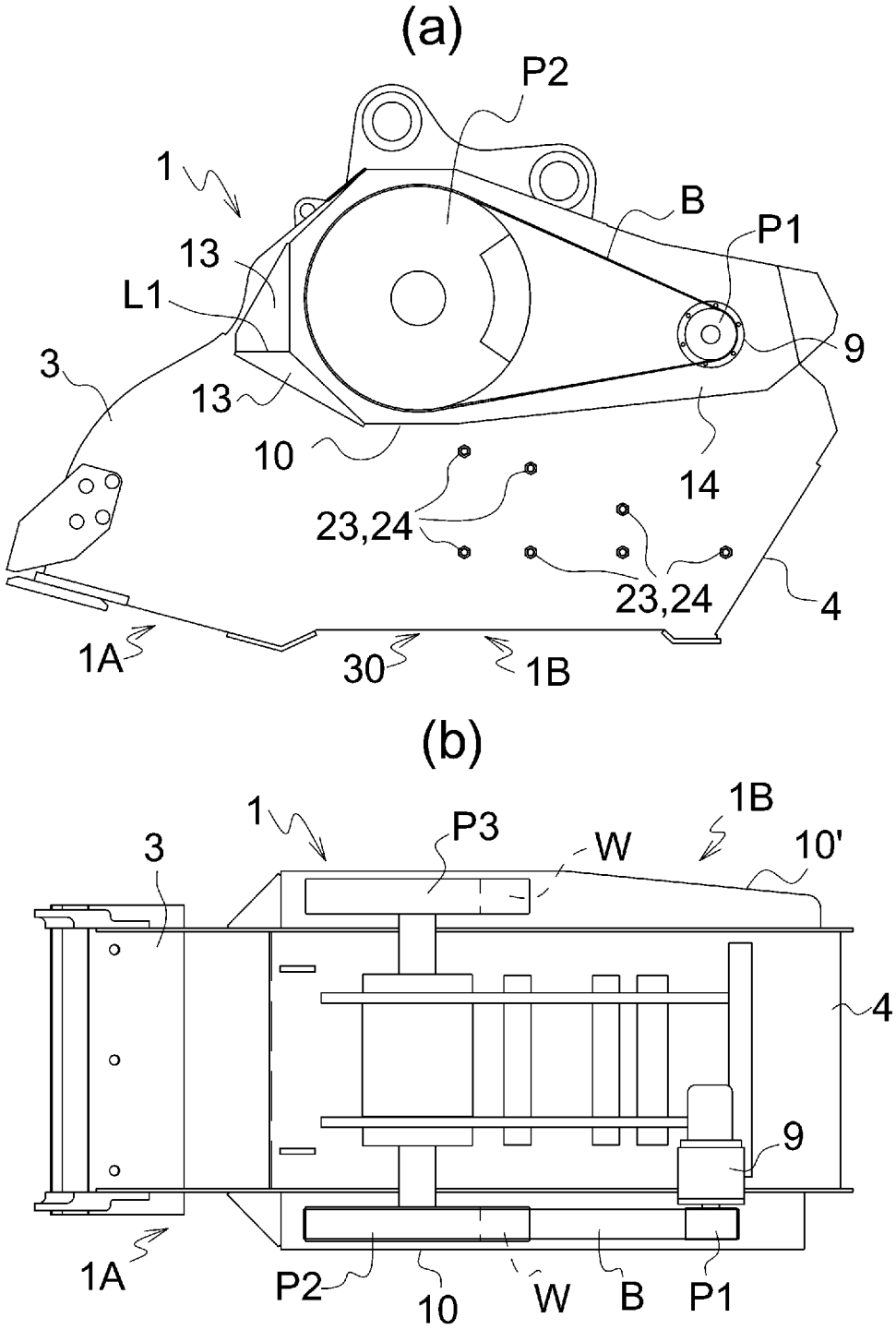
FIG. 1(*a*) is a side view of a bucket-type jaw crusher, and FIG. 1(*b*) is a plan view crossing the inside.

Preferred embodiments of a bucket-type jaw crusher of the present invention will be described below by referring to the attached drawings.

Embodiment 1

In a bucket-type jaw crusher 1 of this embodiment, a bucket 1 attached to an arm 21 of a hydraulic excavator 20 (See FIG. 6) has a scooping portion 1A provided on the inlet side in the front of the bucket, a crusher portion 1B provided in the rear of the scooping portion LA, and an outlet at a rear end of the bucket.

The crusher portion 1B has a fixed jaw 5 fixed in the bucket 1 and a moving jaw 6 opposed to the fixed jaw 5, pivotally supported by an eccentric shaft 7 on the top and supported by a toggle mechanism 8 on the bottom (See FIGS. 2 to 5). Moreover, a driving device for the moving jaw 6 is composed of a driving pulley P1 provided on an output shaft of a piston-type hydraulic motor 9, a driven pulley P2 provided on the eccentric shaft 7, and an endless belt B extended between the both pulleys (See FIG. 1(*a*)).

[Bucket]

The bucket 1 is composed of, as described above, the scooping portion 1A and the crusher portion 1B.

The crusher portion 1B incorporates a crushing mechanism composed of the fixed jaw 5 and the moving jaw 6, has an inlet opening portion 3 for scooping stones and slag and the other materials to be crushed into the scooping portion 1A which becomes the inlet side of the crushing mechanism, has an outlet opening portion 4 on the other which becomes the discharge side of the crushing mechanism, and has a known shape having a crushing passage W penetrating from the inlet opening portion 3 to the outlet opening portion 4.

Figure 10:
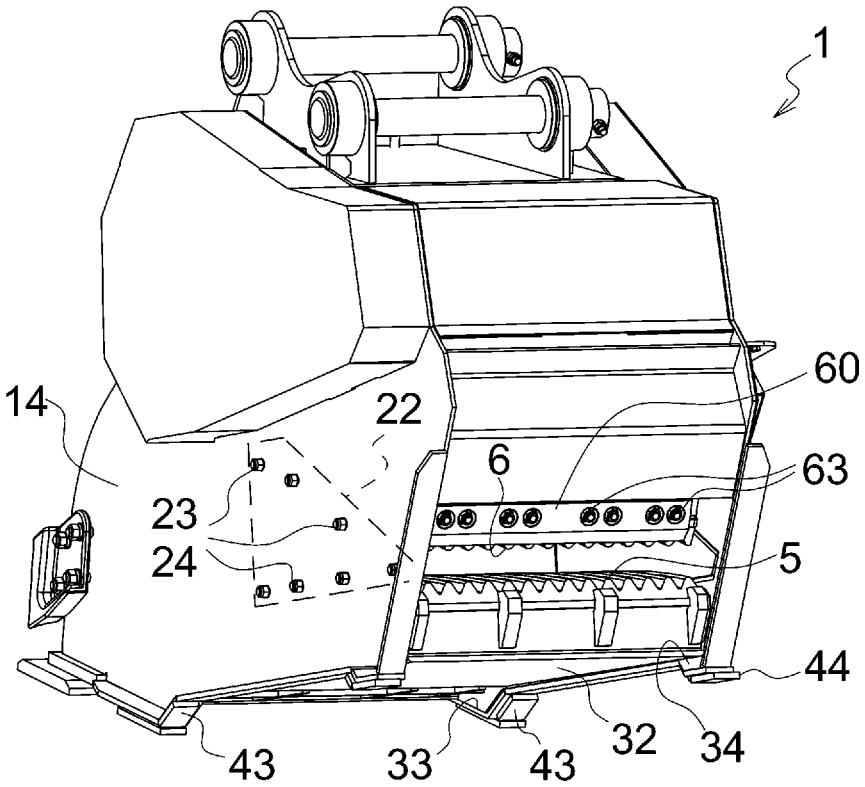
FIG. 10 is a perspective view of the bucket-type jaw crusher when seen from the outlet opening side.

A bottom surface 30 of this bucket 1 is, as illustrated in FIGS. 1 and 10, formed as an inclined surface such that a bottom surface front portion 31 which becomes a bottom surface of the scooping portion 1A has a distal end located at an upper position and gradually lowering.

Moreover, this example has a double-bottom structure in which a scooping surface portion 1*a* formed of a curved surface so as to continue to a distal end of a jaw plate of the fixed jaw, which will be described later, from the inlet distal end of the bucket is provided on the bottom surface of the scooping portion LA.

Since the bucket 1 rotates by using a pivotally attached spot between a bracket and the arm as a fulcrum, the material to be crushed can be smoothly scooped by the scooping surface portion 1*a* and inputted into the crushing mechanism.

Subsequently, a bottom surface of the crusher portion 1B is a bottom-surface main body 32 connecting to the bottom-surface front portion 31 and extending to the rear part and has a raised bottom surface extending substantially horizontally by providing a front leg portion 33 bent upward from a lower end of the inclined surface.

The front leg portion 33 has a substantially V-shaped section in this example, and a rear leg portion 34 having a substantially lying U-shaped section is protruded on a rear end of the bottom-surface main body 32, and the front leg portion 33 and the rear leg portion 34 have substantially the same height.

In this example, each of the front leg portion 33 and the rear leg portion 34 is formed of a frame body provided along a bottom-surface edge portion on the both right and left sides of the bottom surface 30.

Then, the rear end of the bottom surface is inclined upward and becomes right and left edge portions of the outlet opening portion 4 which becomes an outlet.

Moreover, the shapes of the front leg portion 33 and the rear leg portion 34 are not limited to those in this example but may be any shape as long as it protrudes downward.

[Liner Material]

To the front leg portion 33, a front liner material 43 bent having a substantially dogleg-shaped section so as to cover the bottom portion and having abrasion resistance is fixed, and to the rear leg portion 34, a rear liner material 44 made of a flat surface so as to cover the bottom portion is fixed, respectively.

The shape of the liner material can be any as long as it covers the bottom portion of the front leg portion 33 or the rear leg portion 34, and the shape is not limited to that in the above-described example.

As a result, the bottom surface 30 of the bucket 1 is supported at four portions, and the bottom-surface front portion 31 and the bottom-surface main body 32 other than that are both held at a hollow position with respect to the horizontal plane, and thus, the bottom surface 30 hardly touches the material to be crushed and hardly results in rubbing leading to abrasion or damage in scooping of the material to be crushed.

[Fixed Jaw]

The fixed jaw 5 is fixed along the bottom surface side in the bucket 1.

The fixed jaw 5 has one jaw portion (not shown) having an irregular section in which projections and grooves extend in the crushing direction on the front side.

[Moving Jaw]

In the bucket 1, the moving jaw 6 is arranged opposite to the fixed jaw 5, and a space between the fixed jaw 5 and the moving jaw 6 becomes the crushing passage W through which the material to be crushed moves.

The moving jaw 6 has the other jaw portion (not shown) formed of projections and grooves extending in the crushing direction with a shifted pitch so as to mesh with the projections and the grooves on the front side opposite to the jaw portion of the fixed jaw 5.

Figure 2:
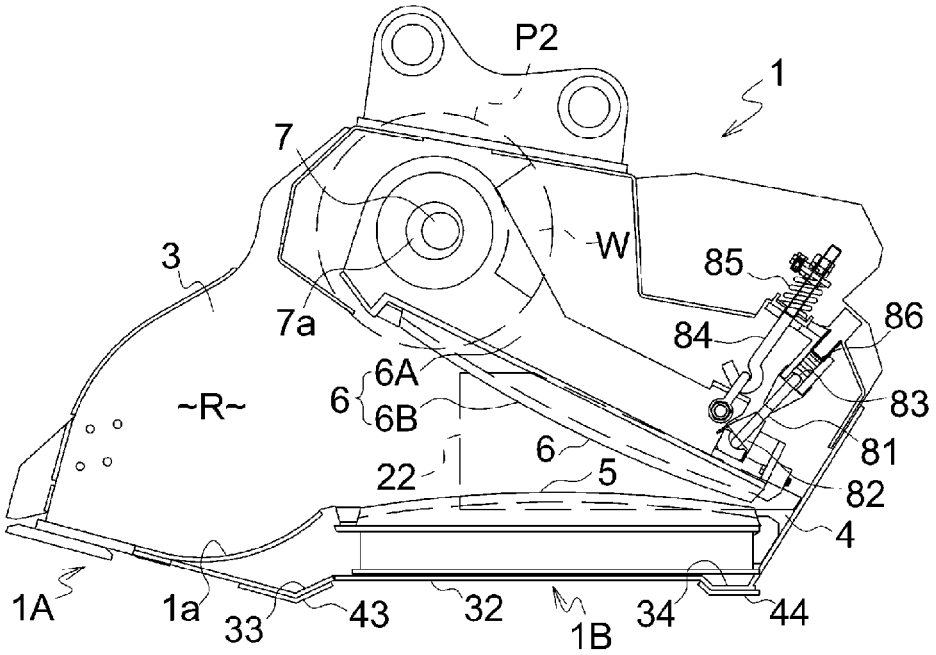
FIG. 2(*a*) is a sectional view of the bucket-type jaw crusher in a state where a crushing mechanism is open, and FIG. 2(*b*) is an enlarged view of a toggle mechanism.
Figure 2:
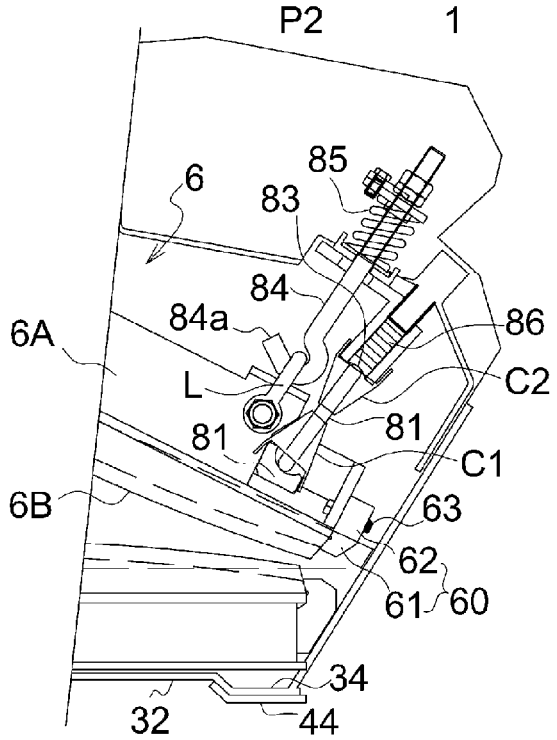

Here, the moving jaw 6 has a structure in which a jaw plate 6B made of manganese is attached to a base frame 6A (See FIG. 2(*b*)).

A jaw-plate fixing claw portion 60 for hooking the jaw plate 6B by the base frame 6A is formed separately from the moving jaw 6.

The jaw-plate fixing claw portion 60 has a hook portion 61 and a base portion 62 formed integrally with the hook portion 61.

In a state where the portion 61 is hooked, the base portion 62 is detachably secured to the base frame 6A by a securing tool 63 such as a bolt and the like.

The bucket-type crusher uses the jaw plate 6B whose weight is smaller than that of a self-propelled crusher or a fixed crusher, but elongation is caused in the jaw plate 6B due to the nature of manganese which is the material, and a load caused by the elongation is applied to the jaw-plate fixing claw portion 60 in contact with the jaw plate 6B.

Then, the elongation of the jaw plate 6B can be absorbed by adjusting the tension of the securing tool such as a bolt and the like or by damaging or breaking the jaw-plate fixing claw portion 60.

The damaged or broken jaw-plate fixing claw portion 60 can be easily replaced by removing the securing tool.

The moving jaw 6 is fixed on the upper part to the eccentric shaft 7 pivotally supported rotatably in the forward and reverse directions in the bucket and is supported on the lower part by a toggle plate 81 constituting the toggle mechanism 8 through a load receiving portion 82, and the inlet opening portion 3 of the bucket 1 is arranged having a substantially tapered shape such that a space between the fixed jaw 5 and that the moving jaw 6 is opened wide as an inlet and gradually narrows toward the outlet opening portion 4 of the bucket 1 and becomes an outlet at the distal end.

[Toggle Mechanism]

In this example, the toggle mechanism 8 is composed of the toggle plate 81, a first load receiving portion 82 which becomes a movable side toggle seat as a receiving portion for the toggle plate 81 and a second load receiving portion 83 which becomes a fixed side toggle seat, and a tension rod 84.

The toggle plate 81 is formed such that each of both ends of a support column main body in contact with the first load receiving portion 82 and the second load receiving portion 83 has an arc-shaped section or more preferably a substantially semicircular section.

Moreover, the first load receiving portion 82 is fixed to a lower end of the moving jaw 6, and has a contact surface having an arc-shaped section set with the same direction as the arc of the other end portion of the toggle plate 81 and a larger diameter curvature in point contact with the other end portion on the section.

In the illustrated example, it is composed of a curved surface along a rotation trajectory of the end portion around the center of the toggle plate 81.

Here, the other end portion of the toggle plate 81 and the contact surface of the first load receiving portion 82 are both subjected to heat treatment and have abrasion resistance.

The second load receiving portion 83 is provided on the bucket frame and has a contact surface having an arc-shaped section set with a larger diameter curvature than that of one end portion of the toggle plate 81 in point contact with the other end portion on the section.

In the illustrated example, it is composed of a curved surface set with a curvature larger than that of one end portion and a curvature smaller than that of the contact surface of the first load receiving portion 82 so that the other end of the toggle plate 81 can roll in conjunction with respect to the second load receiving portion 83 displaced integrally with the displacement of the moving jaw 6.

Here, too, one end portion of the toggle plate 81 and the contact surface of the second load receiving portion 83 are both subjected to the heat treatment and have abrasion resistance.

As a result, the both end portions of the toggle plate 81 can smoothly roll around the center of the toggle plate 81 as the rotation center while in linear contact (point contact on the section) with the first load receiving portion 82 and the second load receiving portion 83.

This toggle plate 81 is constrained so that the contact spot does not remove from the receiving surface (contact surface) through the tension rod 84 having a U-shaped hook portion 84*a* at a distal end hooked by a ring L fixed to the moving jaw 6 and a spring 85 and is attached with up grade closer to the eccentric shaft 7 side than the perpendicular surface of the moving jaw 6 and thus, the moving jaw 6 having the lower part of the moving jaw 6 moving in a substantially circularly and reciprocally swinging on the inlet opening portion side in the approaching or separating direction with respect to the fixed jaw 5 by rotation (forward rotation) of the eccentric shaft 7 is operated while being pressed onto the fixed jaw 5 sandwiching the material to be crushed.

By increasing/decreasing the number of attached adjustment plates 86 on the lower face of the lower load receiving portion 83, the gap between the moving jaw 6 and the lower end of the fixed jaw 5 can be adjusted and a crushing dimension of the material to be crushed can be increased/decreased.

Moreover, by providing a fixed-sided cover C1 for dust-proof fixed through the toggle plate 81 so as to cover the contact surface between one end portion of the toggle plate 81 and the second load receiving portion 83, and similarly by providing a movable-side cover C2 for dust-proof fixed through the toggle plate 81 so as to cover the contact surface between the other end portion of the toggle plate 81 and the first load receiving portion 82, even if the bucket-type jaw crusher is turned upside down, the toggle mechanism is not affected by dusts.

Figure 3:
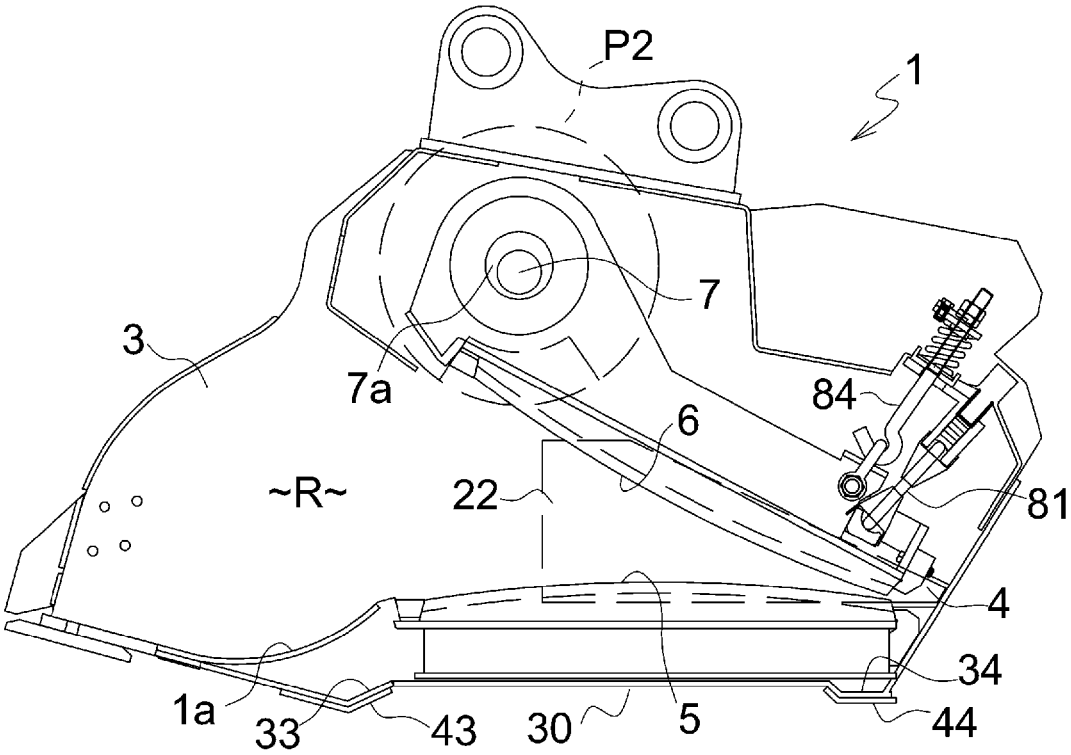
FIG. 3 is a sectional view of the bucket-type jaw crusher in an intermediate state of the crushing mechanism.
Figure 4:
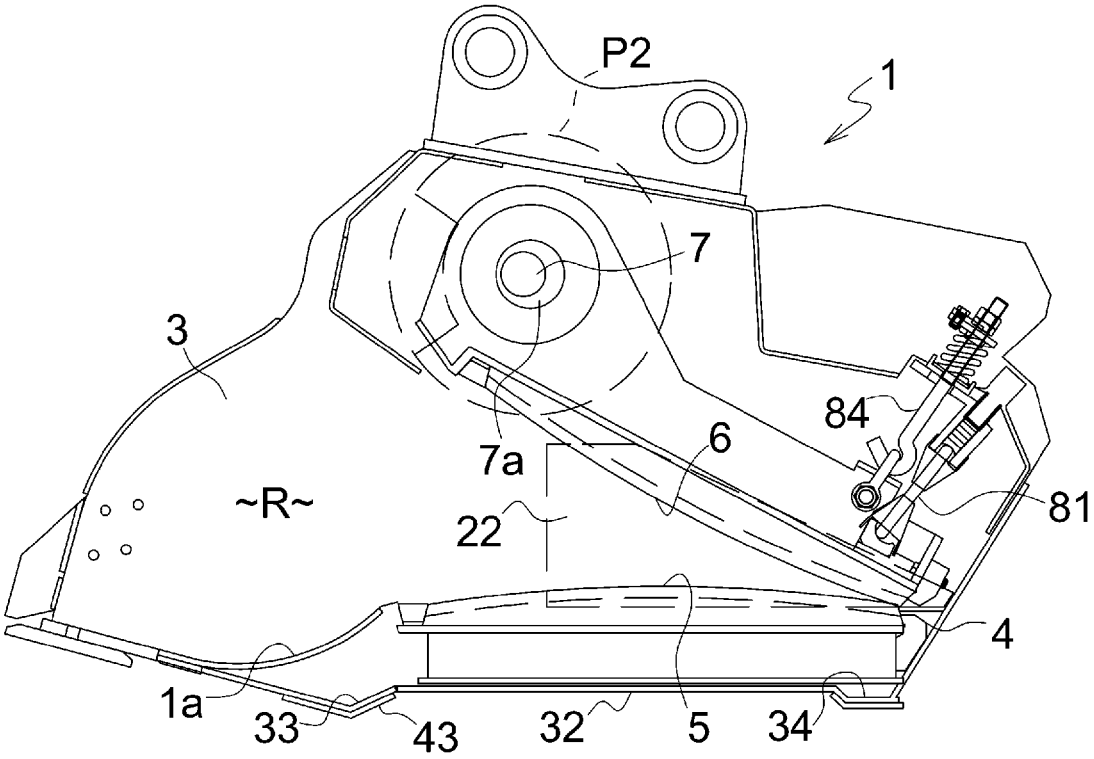
FIG. 4 is a sectional view of the bucket-type jaw crusher in a state where the crushing mechanism is closed.
Figure 5:
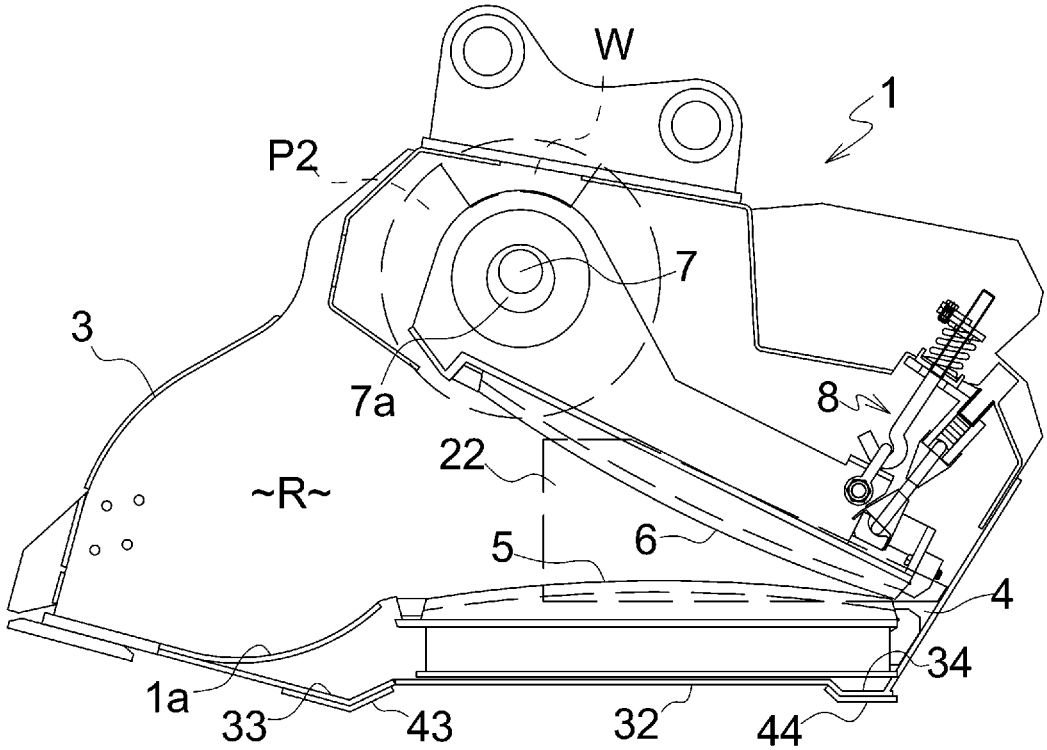
FIG. 5 is a sectional view of the bucket-type jaw crusher in an intermediate pressurized state of the crushing mechanism.

Here, FIG. 2(*a*) is a diagram of a state where the outlet opening portion 4 is fully opened by rotation of the eccentric shaft 7, FIG. 3 is a diagram of an intermediate state where the eccentric shaft 7 is rotated by 90 degrees clockwise in the figure and the rotation shaft center of the eccentric shaft 7 is displaced, FIG. 4 is a diagram of a state where the shaft is further rotated by 90 degrees and the outlet opening portion 4 is closed, and FIG. 5 is a diagram of an intermediate compressed state where the shaft is further rotated by 90 degrees and the rotation shaft center of the eccentric shaft 7 is displaced.

[Liner Plate]

Figure 11:
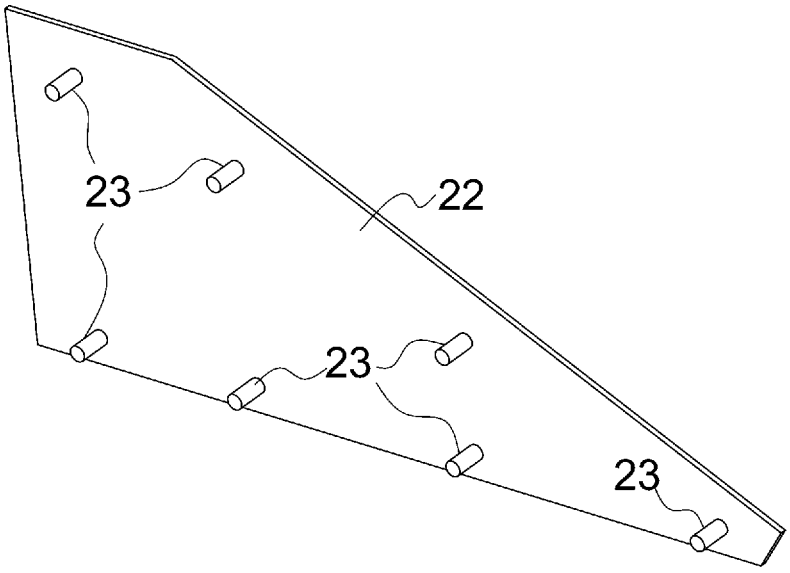
FIG. 11 is a perspective view of a liner plate.

On the bucket side plate of the crusher portion 1B, a liner plate 22 made of high manganese cast steel is detachably attached as an example of an abrasion-resistant material on the inner side (See FIG. 11).

That is, the bucket side plate of the crusher portion 1B is hit and jostled by the material to be crushed and worn and damaged all the time while the crushing mechanism is operating.

The worn portion can be repaired by abrasion-resistant weld overlay in maintenance, but it gives a great influence on the life of the entire bucket.

On the other hand, since the bucket-type jaw crusher 1 is attached at the arm distal end of the construction machine, the entire weight is restricted.

Thus, the substantially triangular liner plate 22 is detachably attached to the side plate in correspondence so as to fully cover the side face of an opening posture (waiting posture) of the fixed jaw 5 and the moving jaw 6 which constitute the crushing mechanism on the side plate of the crusher portion 1B.

In this example, the liner plate 22 starts at the substantially intermediate position as a base end on the inlet side which becomes the center in the longitudinal direction of the fixed jaw 5 and the moving jaw 6 in the opening posture and a base end of the jaw, gradually narrows and extends to the outlet in the illustrated example.

Moreover, in the case of the illustrated example, the base end sides have the same width and a substantially U-shape.

To this liner plate 22, a stud bolt 23 protruding outward horizontally is integrally fixed (deposited), and a bolt hole 24 is drilled at a position corresponding to the stud bolt 23 in the side plate of the crusher portion 1B.

Thus, by placing the liner plate 22 on the inner wall surface side of the side plate, by inserting the stud bolt 23 through the bolt hole 24 so as to protrude it to the outside of the side plate and by securing the protruding portion with a nut 25, the liner plate 23 can be detachably fixed to the inner wall surface of the side plate 2.

As a result, even if the material to be crushed is pressed by the crushing mechanism, the side plate of the bucket is not damaged but the life can be prolonged.

[Cover]

As described above, the eccentric shaft 7 and the output shaft of the hydraulic motor 9 protrude to the front on the outside of the side plate 2 of the bucket, the driven pulley P2 is connected to the eccentric shaft 7, and a face-wheel shaped counterweight W for accumulating crushing energy is also attached.

To the rear on the outside of the side plate 2, the driving pulley P1 connected to the output shaft of the hydraulic motor 9 is connected and belt-transmitted by the endless belt B.

Figure 13:
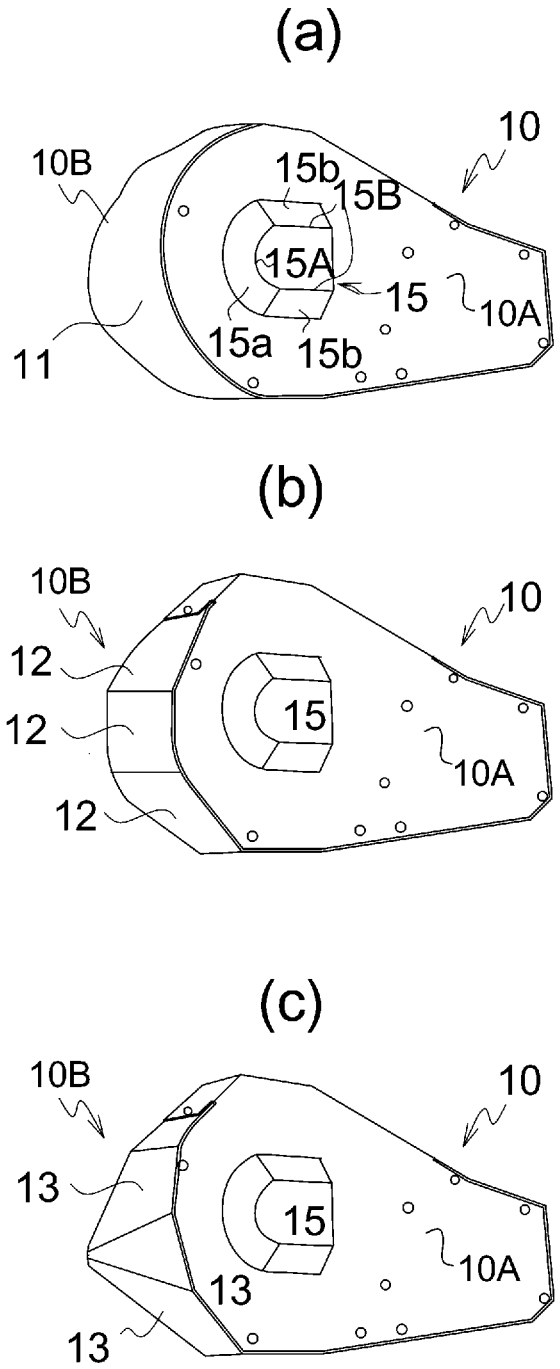
FIG. 13(*a*) is a perspective view illustrating an example of a cover, FIG. 13(*b*) is a perspective view illustrating another example of the cover, and FIG. 13(*c*) is a perspective view illustrating a different example of the cover.

As obvious from FIG. 13, the cover 10 is attached for protection and security of the pulleys P1 and P2 and the endless belt B.

The cover 10 is formed of an outer wall portion in which the front part has a substantially semicircular shape with a large diameter in order to cover the driven pulley P2 with a large diameter, the intermediate part gradually narrows in the width, and the rear part is formed of an inverted substantially semicircular shape with a small diameter in order to cover the driven pulley P1 with a small diameter and spaced from the side plate 2 of the bucket in parallel and a peripheral wall portion 10B closing a gap between the outer wall portion 10A and the side plate 2 of the bucket.

On a side plate 2' on the opposite side of the bucket, the other end of the eccentric shaft 7 protrudes outward, a flywheel P3 having the same size as that of the driven pulley P2 is connected and also, the counter weight W is attached.

In this example, a similar cover 10' is attached for protection and security of the flywheel P3.

The cover 10' may have the same shape as that of the cover 10 on the opposite side or may have a shorter shape only to cover the flywheel P3.

In the cover 10, an inclined surface is formed on the peripheral wall portion 10B located on the inlet opening 3 side of the bucket.

That is, a distal end of the peripheral wall portion 10B is attached in contact with the side plate 2 of the bucket in the front of the front profile of the outer wall surface 10A of the cover 10, and a surface from the distal end to a distal-end edge portion of the outer wall surface 10A is set as a gradually raised inclined surface.

In the prior-art cover, the peripheral wall portion is a perpendicular surface upright substantially orthogonal to the side plate 2, and thus, an impact of the material to be crushed dropped from the bucket hits the peripheral wall portion at a right angle particularly on the front surface portion faced with the front, and it is concerned that the peripheral wall portion and the corner portion of the outer wall portion are deformed or damaged, but in this example, the peripheral wall portion 10B is formed as an inclined surface so that the impact of the material to be crushed is relaxed and deformation or damage of the cover 10 can be prevented.

FIG. 13(*a*) illustrates a structure in which the peripheral wall portion 10B of the cover 10 is set as a series of inclined surfaces, and a structure in which the shape of a distal end edge portion of the outer wall surface 10A has a substantially arc shape, and the distal end of the peripheral wall portion 10B is set as a substantially arc shape having a substantially concentric large diameter with the distal end edge portion of the outer wall surface 10A and attached to the side plate 2 in contact at a position spaced to the front from the outer wall surface 10A of the cover 10 so as to form a series of substantially C-shaped inclined surfaces 11.

FIG. 13(*b*) illustrates a case where the peripheral wall portion 10B on the front of the cover 10 is formed as a shape of combination of a plurality of inclined surfaces, in which the distal end edge portion of the peripheral wall portion 10B is attached in contact with the side plate 2 at a position spaced to the front from the outer wall surface 10A of the cover 10 so as to form a shape in which the distal end edge portion of the peripheral wall portion and the distal end edge portion of the outer wall surface are connected by a plurality of substantially square inclined surfaces 12.

FIG. 13(*c*) has a shape of combination of substantially triangular or echelon-shaped inclined surfaces instead of a square shape and the peripheral wall portion 10B on the front has a shape formed by combining substantially triangular or substantially echelon-shaped inclined surfaces 13.

It is only necessary that the inclined surfaces 11 to 13 are inclined outward from the side plate 2 and may be further inclined upward or inclined downward.

Moreover, a ridge line portion is preferably formed as a curved surface without a corner.

In this example, the inclined surface inclined with respect to the side plate 2 is illustrated, but since it is only necessary that the surface is inclined with respect to the direction where the material to be crushed hits, even a perpendicular surface orthogonal to the side plate 2 can be used as the inclined surface if it is on the upper part or the lower part of the peripheral wall portion 10B, and the front peripheral wall portion 10B can be formed by combining them.

Moreover, at the middle position of the outer wall surface 10A of the cover 10, a raised portion 15 in which a front part has a substantially semicircular shape and a rear part has a substantially rectangular shape is formed.

A surface 15*a* in the thickness direction with respect to a ridge line 15A having a semicircular shape of the raised portion 15 is curved in an arc shape, and upper and lower rectangular ridge lines 15B are formed as inclined surfaces 15*b* gradually inclined outward from the inside.

Since the material to be crushed can be guided to the outside of the cover 10 by each of the inclined surfaces, the material to be crushed does not directly hit the peripheral wall surface 10B of the cover 10, and deformation or damage can be prevented.

A configuration similar to the above configuration can be also used for the cover 10'.

[Driving Structure]

The eccentric shaft 7 protrudes outward at a position closer to the inlet opening portion 3 of the one side plate 2 of the bucket 1, and the driven pulley P2 having a large diameter which becomes a flywheel is fixed to the protruding portion.

The eccentric shaft 7 has a known structure in which an eccentric portion 7*a* having a circular section with a large diameter is integrally attached to the rotation shaft of the driven pulley P2 at a position biased from the center of the rotation shaft.

The flywheel P3 forming a pair is attached to the outside of the side plate 2' coaxially corresponding to the driven pulley P2.

In the figure, reference character W denotes a counterweight fixed to the driven pulley P2 and the flywheel P3.

Moreover, along the one side plate 2, the piston-type hydraulic motor 9 is fixed on the inner side of the side plate 2 at a position spaced from the eccentric shaft 7 to the outlet opening portion 4 side (See FIG. 1(*b*)).

A hydraulic circuit built in this bucket-type jaw crusher and provided with the piston-type hydraulic motor 9 is connected to a known hydraulic circuit (not shown) of the hydraulic excavator 20.

Figure 12:
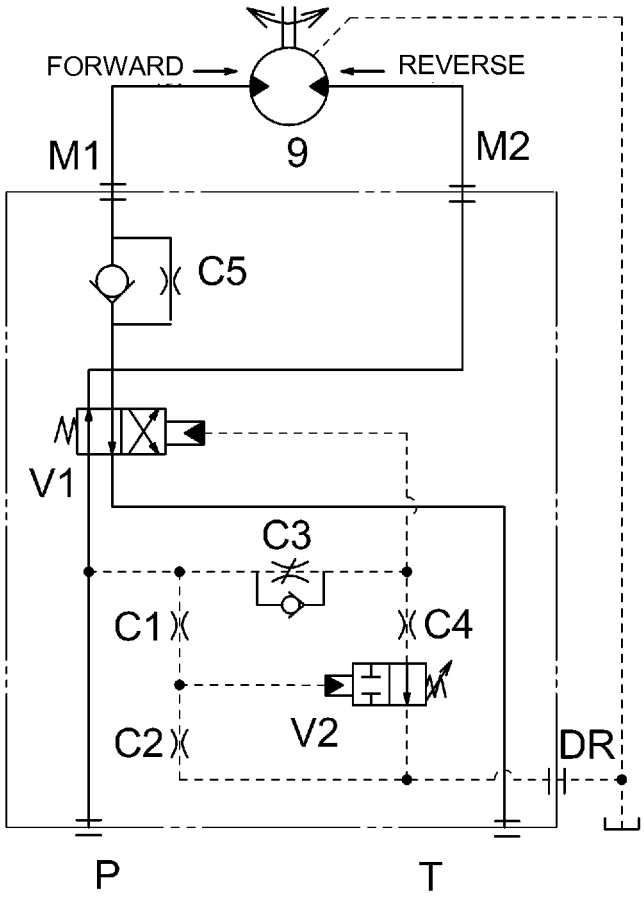
FIG. 12(*a*) is a hydraulic circuit diagram built in the bucket-type jaw crusher, and FIG. 12(*b*) is a block diagram.
Figure 12:
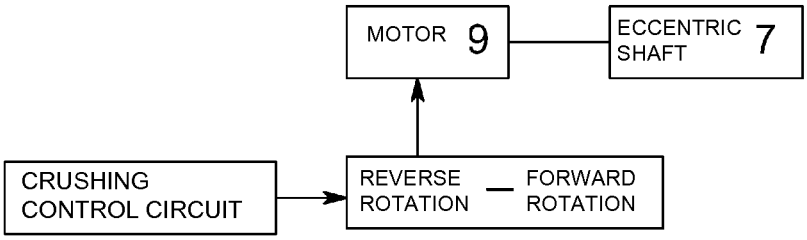

The hydraulic circuit built in the bucket-type jaw crusher illustrated as an example in this example has, as illustrated in FIG. 12(*a*), a port P on the pump side and a port T on the tank side of the hydraulic circuit for attachment equipped in the hydraulic excavator 20 connected to the piston-type hydraulic motor 9 having a port on the forward rotation side and the port on the reverse rotation side.

When the hydraulic motor 9 is rotated forward, the moving jaw 6 moves in the crushing direction through the eccentric shaft 7.

In this hydraulic circuit, a crushing control circuit having first and second hydraulic pilot switching valves V1 and V2, diaphragms C1, C2, and C4 and check valves C3 and C5 is provided.

If an operator steps on a pedal for crushing work, not shown, provided in the hydraulic excavator 20, since a hydraulic pressure of a line inputted from the P port is low at the initial stage of stepping-on of the pedal, the first hydraulic pilot switching valve V1 is at a reverse position (a) in the illustration by a biasing force of the spring, and oil is supplied to a port M2 on the reverse rotation side of the hydraulic motor 9.

As a result, if the hydraulic motor 9 starts reverse rotation, the oil flowing out of the hydraulic motor 9 flows into the check valve C5 from an M1 port, passes through the first hydraulic pilot switching valve V1 and returns to the T port.

The oil having passed through the check valve C5 has its flow rate limited and thus, the reverse rotation of the hydraulic motor 9 can be performed slower than forward rotation.

Moreover, the oil flowing into the pilot line indicated by a dotted line in the figure from the P port has its pressure gradually raised by the diaphragms C1 and C2, and when the pressure reaches a certain value, the second hydraulic pilot switching valve V2 is switched from a passage position (c) to a drain illustrated in the figure to a shut-off position (d), a pressure oil is fed to a pilot port of the first hydraulic pilot switching valve V1 so as to switch the first hydraulic pilot switching valve V1 to a forward rotation position (b), the oil is supplied to the port M1 on the forward rotation side of the hydraulic motor 9, and the hydraulic motor 9 is rotated forward.

The oil passes through an M2 port from the hydraulic motor 4, passes through the first hydraulic pilot switching valve V1 and returns to the T port.

As a result, in the crushing work, the hydraulic motor 9 can be rotated reversely only in the initial stage of the stepping-on of the pedal and after that, the hydraulic motor 9 can be rotated forward.

The number of reverse rotations in the initial stage is preferably less than 1 rotation to approximately several rotations, but the number is not particularly limited in the present invention.

By adjusting the pilot pressure, the switching timing of the position of the first hydraulic pilot switching valve V1 can be changed and it can be determined as appropriate experimentally in accordance with conditions such as the type and the shape of the material to be crushed.

In the above-described example, a mode of one-way circulation is used is explained as an example of a hydraulic circuit for attachment equipped in the hydraulic excavator, but such hydraulic circuit is not limiting in the present invention.

For example, a mode in which a direction of circulation is switched by a directional switching valve between the forward rotation and the reverse rotation may be used.

Regarding the hydraulic circuit, any circuit configuration may be employed as long as the hydraulic motor 9 is reversed automatically at first when the pedal is stepped on and then, rotated forward continuously.

Figure 8:
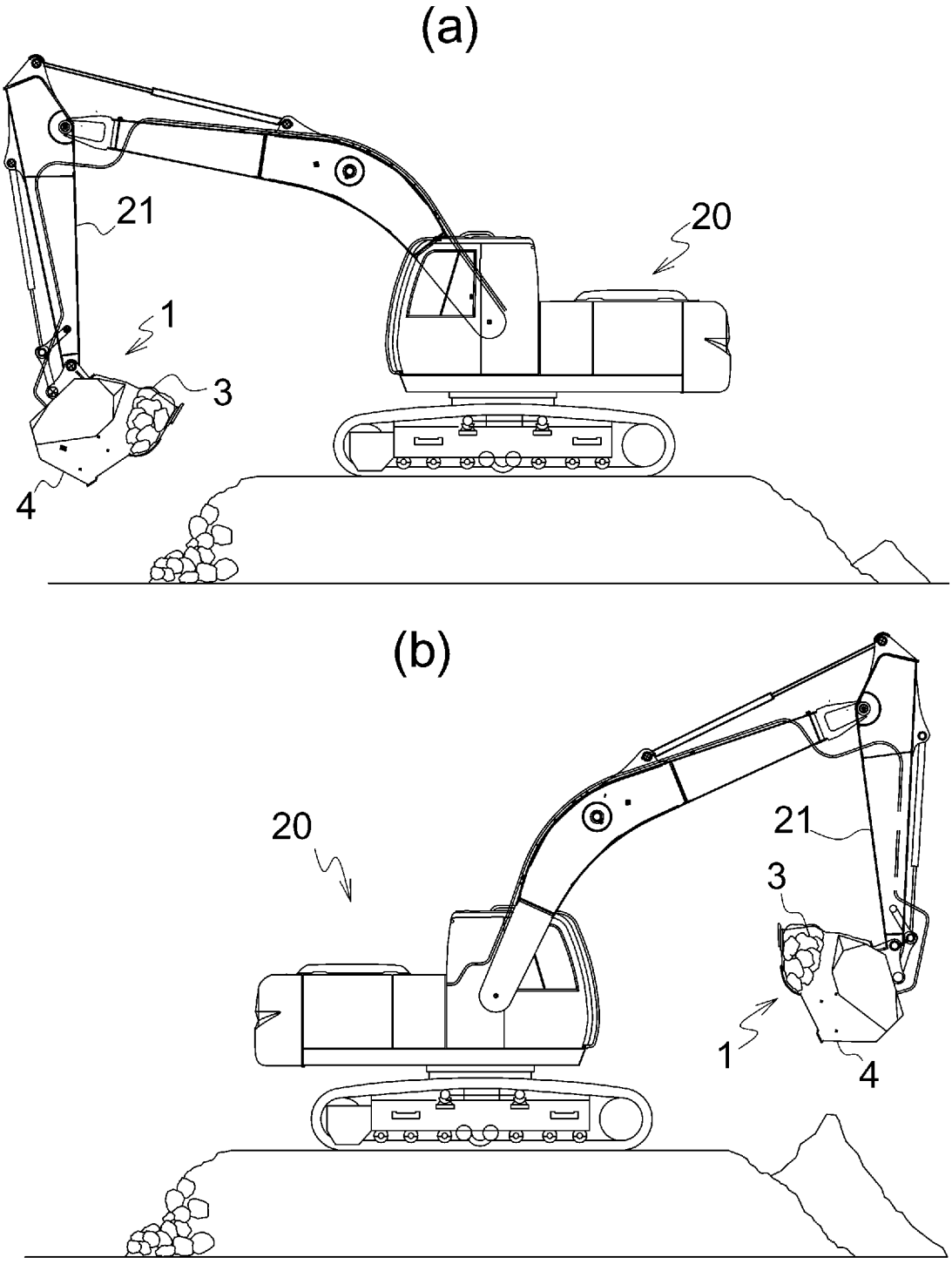
FIG. 8(*a*) is a side view of a state where an outlet opening of the bucket is oriented downward and raised, and FIG. 8(*b*) is a side view of a state where an upper revolving body of a construction machine is reversed and a material to be crushed is discharged to a discharge spot of the hydraulic excavator.

As a result, in the bucket-type jaw crusher in which the crushing treatment is started from a choke state of the hard material to be crushed such as slag and the like at a position where the opening of the bucket is faced substantially above as illustrated in FIG. 8(*b*), crushing can be performed by using motion characteristics of the moving jaw 6 generated by the single toggle mechanism.

Moreover, if the moving jaw is stopped due to biting of a hard foreign substance such as metal or the like contained in the slag or the like during the work, first, the motor 9 is stopped so as to stop the crushing treatment.

Figure 6:
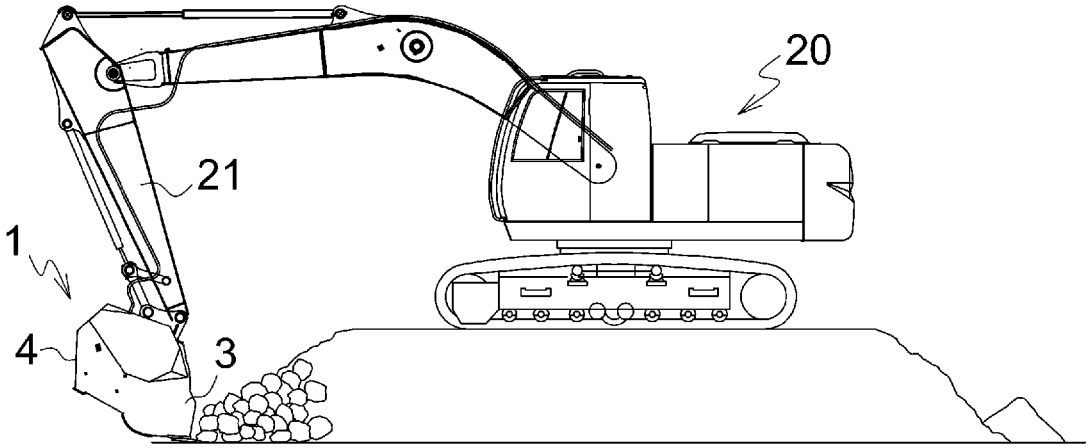
FIG. 6(*a*) is a side view of a hydraulic excavator in a state where an inlet opening of the bucket is oriented downward, and FIG. 6(*b*) is a side view of the hydraulic excavator in a state where a distal end of the bucket is penetrated in a material to be crushed.
Figure 6:
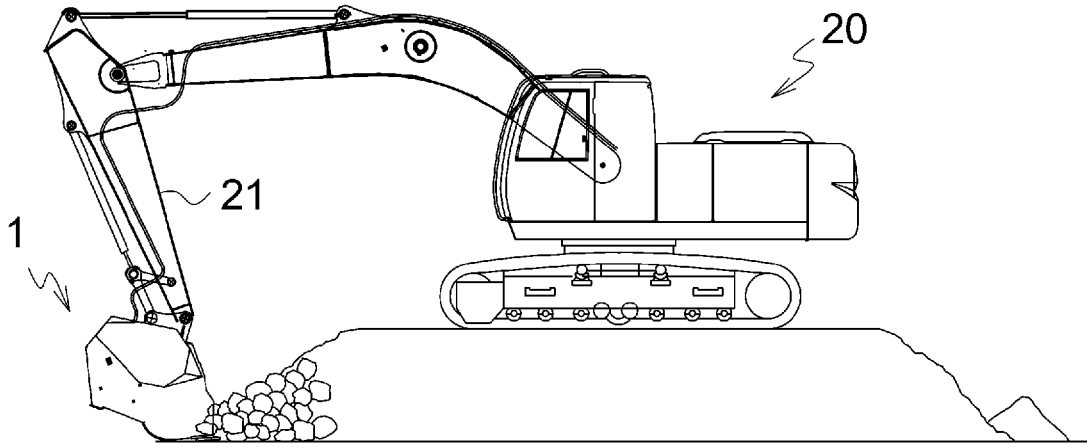
Figure 7:
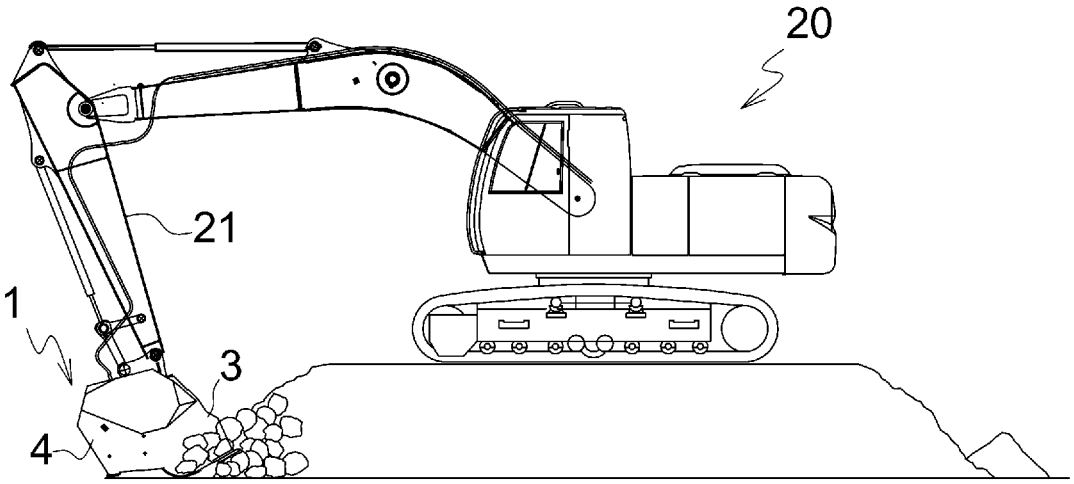
FIG. 7(*a*) is a side view of a state of scooping by the bucket, and FIG. 7(*b*) is a side view of a tilted-up state of the hydraulic excavator.
Figure 7:
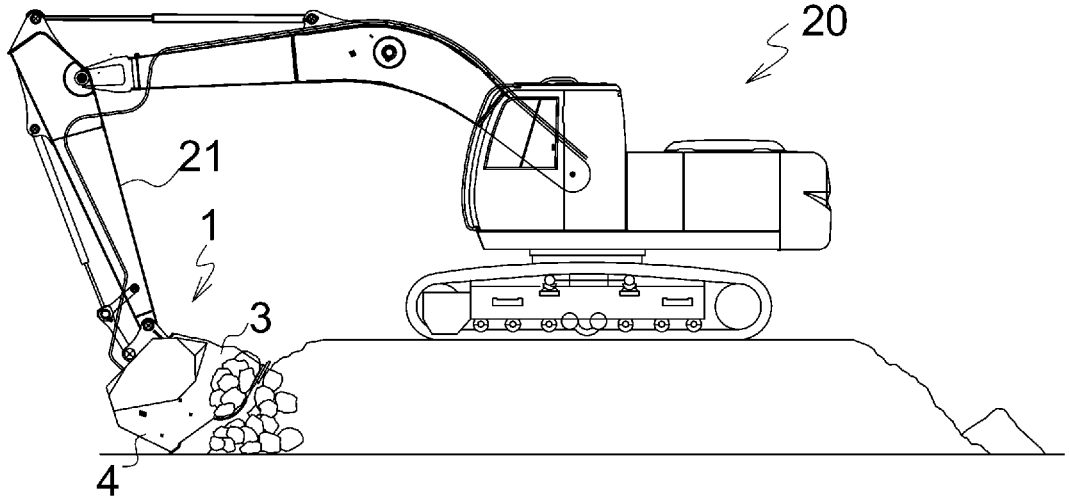

Then, the arm of the hydraulic excavator is moved upward, and the bucket 1 is reversed at the same time (See FIG. 6).

As a result, the material to be crushed remaining in the crushing passage W in the bucket 1 drops.

Subsequently, when the operator steps on an operation pedal for the crushing work, the hydraulic motor 9 is first reversed and thus, this operation can be used for removing the bitten foreign substances.

The output shaft of the piston-type hydraulic motor 9 configured as above protrudes outward from the side plate 2, and the driving pulley P1 with a small diameter is fixed to the protruding portion.

As a result, the driven pulley P2 and the driving pulley P1 are juxtaposed on the outside of the side plate 2, the endless belt B is extended between the driven pulley P2 and the driving pulley P1, and a flat belt is used for the endless belt B so as to form a flat belt transmission structure.

As configured as above, first, the crushing mechanism rotates the driven wheel P2 attached to the eccentric shaft 7 by using the flat belt B from the driving pulley P1 connected to the output shaft of the hydraulic motor 9 incorporated in the bucket 1.

The eccentric shaft 7 rotates eccentrically and gives a reciprocating swing motion to the discharge side of the moving jaw 6 in combination with the toggle mechanism 8 provided on the discharge side of the moving jaw 6.

The crushing passage W of the crushing mechanism has its capacity gradually narrowing toward the outlet (discharge) side from the inlet (supply) side.

With the purpose of obtaining the reciprocating swing motion, a compression load for crushing is applied to the material to be crushed moving downward by the gravity.

If the material to be crushed is a hard slag, the eccentric shaft 7 is subjected to a strong impact load in crushing all the time, but the driven pulley P2 of the flywheel accumulates energy in returning of the moving jaw 6 and emits it in compression crushing so as to relax a large load fluctuation.

Moreover, by employing a flat belt for the endless belt B, a large impact load received when a hard foreign substance such as metal contained in the slag is bitten can be relaxed by momentary elongation or slip.

Furthermore, the action of the belt driving reduces a load to the output shaft of the hydraulic motor for driving and lowers a risk of oil leakage from around the shaft.

The belt driving means an increase of the output shaft torque of the hydraulic motor 9 by 4 to 5 times to the contrary by reducing the speed of the rotation number of the output shaft of the hydraulic motor 9 rotating at a high speed in a range of approximately ¼ to ⅕ in the eccentric shaft 7 in this example, and the design around the driving can be made compact.

In the present invention, the material to be crushed is not particularly limited but since the present invention is suitable for the crushing treatment of the slug, it may be used for a slag crusher.

Figure 9:
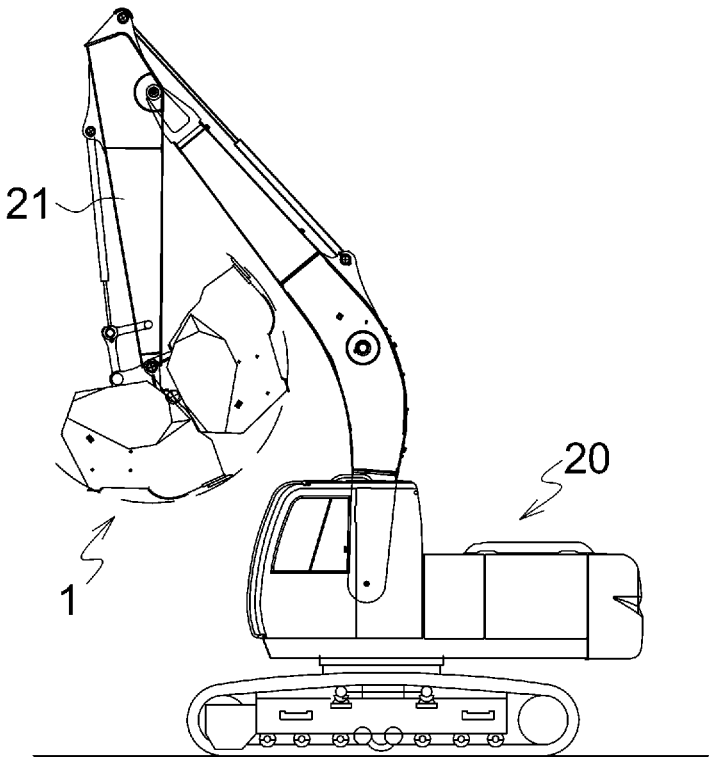
FIGS. 9(*a*) and 9(*b*) are side views illustrating a state where the bucket can be turned without meeting a boom or an arm of the construction machine.
Figure 9:
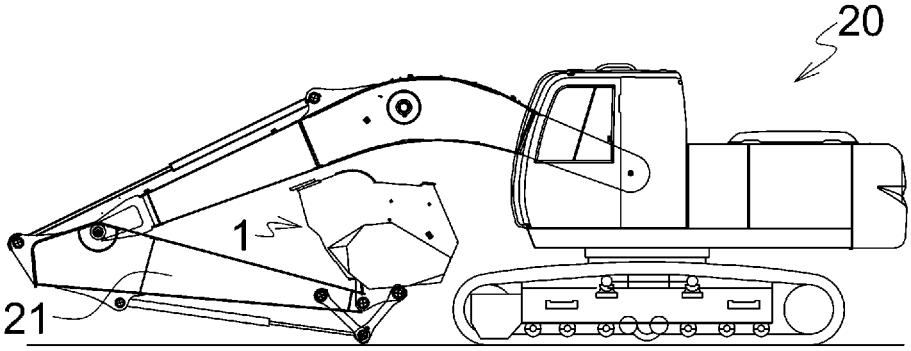

In this example, since the outer peripheral shape of the bucket is set so as to have a rotation trajectory not interfering with the boom or arm of the construction machine, its workability is excellent (See FIGS. 9(*a*) to 9(*c*)), but the above-described shape is not limiting in the present invention.

Moreover, the case of using the hydraulic motor as a motor is described in the above-described example, but the hydraulic circuit is not limited to the structure in the example. Moreover, an electric motor may be used instead of the hydraulic motor and an electric circuit for controlling it may be used.

In the case of the electric motor 9, too, it is only necessary that such a crushing control circuit is provided in which if the operator steps on the pedal for the crushing work or turn on a switch in the construction machine, the electric motor first reverses the rotation of the eccentric shaft 7 and then, rotates the eccentric shaft forward soon so as to perform the crushing work (See FIG. 12(*b*)).

Particularly, when the electric motor is used, if the crushing treatment is to be performed only by forward rotation, an overload or 200 to 300% of the electric motor rate is applied by an overload by a choke, and the machine cannot be stopped without disconnecting a thermal relay or fuse, which causes a failure if it is repeated frequently. Thus, the machine needs to be protected by an overload relay or the like, but by first reversing the rotation of the shaft and then, rotating it forward in the crushing work, such nonconformity can be prevented.

In addition, the present invention is not limited to the above-described example or in short, the present invention is capable of various design changes in a range not changing the gist of the invention.

REFERENCE SIGNS LIST

1 bucket
2 side plate
3 inlet opening portion
4 outlet opening portion
5 fixed jaw
6 moving jaw
7 eccentric shaft
8 toggle mechanism
9 piston-type hydraulic motor
10 cover
20 hydraulic excavator
21 arm
81 toggle plate
82 first load receiving portion
83 second load receiving portion
84 tension rod
85 spring
B endless belt
P1 driving pulley
P2 driven pulley
W crushing passage

The invention claimed is:

1. A jaw crusher provided with a bucket attached to an arm of a construction machine, a fixed jaw fixed in the bucket, and a moving jaw opposed to the fixed jaw and pivotally supported on the top by an eccentric shaft and supported on the bottom by a toggle mechanism, the fixed jaw and the moving jaw being arranged such that a space on a scooping side of the bucket is opened wide as an inlet and is gradually narrowed toward the depth and continues to an outlet of the bucket, for crushing materials to be crushed by swing of the moving jaw, wherein the jaw crusher comprises a motor for rotating the eccentric shaft forward and reverse and provided in the bucket;

a pedal for crushing work; and crushing control means which, when the pedal for crushing work is initially operated, automatically rotates the eccentric shaft in reverse by reversing the motor first and then, rotates the shaft forward for crushing the material.

2. A jaw crusher with a bucket comprising:

a hydraulic circuit provided with a hydraulic motor connected to a hydraulic circuit of a construction machine and rotating an eccentric shaft forward and reverse and provided in the bucket; and a pedal for crushing work, wherein the hydraulic circuit has crushing control means for, when the pedal for crushing work is initially operated, automatically reversing the eccentric shaft by reversing the hydraulic motor first and then, rotating the shaft forward for crushing of a material to be crushed.

3. The jaw crusher according to claim 1, wherein the toggle mechanism comprises a toggle plate having longitudinal ends, each formed having an arc section, a fixed-side toggle seat having a contact surface provided on a bucket frame and in point contact on an arc-shaped section with one of the longitudinal ends of the toggle plate and having a larger diameter curvature than the one of the longitudinal ends, and a movable-side toggle seat having a contact surface provided on a moving jaw and in point contact on an arc-shaped section with the other of the longitudinal ends and having a larger diameter curvature than the other of the longitudinal ends.

4. The jaw crusher according to claim 3, further comprising:

a fixed-side cover for dust-proof covering a contact surface between the one end of the toggle plate and the fixed-side toggle seat and a movable-side cover for dust-proof covering the contact surface between the other end of the toggle plate and the movable-side toggle seat.

5. The jaw crusher according to any one of claim 1 or 3, wherein the moving jaw has a structure in which a jaw plate is attached onto a base frame;

a jaw-plate fixing caw portion for hooking the jaw plate by the base frame is formed separately from the moving jaw, and the jaw-plate fixing claw portion has a hook portion and a base portion integrally formed with the hook portion; and at a distal end of the moving jaw which becomes the discharge outlet side, in a state where the hook portion is hooked by the distal end of the jaw plate, the base portion is detachably secured to the base frame by a securing tool.

6. The jaw crusher according to any one of claim 1 or 3, wherein a liner plate made of a substantially triangular abrasion-resistant steel plate corresponding to an opening posture of the fixed jaw and the moving jaw is arranged inside right and left side plates of a crusher portion, and a stud bolt protruding outward is fastened to the liner plate detachably fixed by a nut from the outside of the respective side plates.

7. The jaw crusher according to any one of claim 1, 2 or 3, wherein a bottom surface of a scooping portion of the bucket is set as an inclined surface gradually lowering and inclined from a distal end; and a bottom surface of a crusher portion is a raised bottom surface extending substantially horizontally through a front leg portion bent upward from a lower end of the inclined surface and has a rear leg portion bent downward from the raised bottom surface in the vicinity of the outlet of the bucket in the rear of the raised bottom surface and arranged at a substantially same height position as the front leg portion.

8. The jaw crusher according to claim 2, wherein the hydraulic motor includes a forward port for forward rotation and a reverse port for reverse rotation, and wherein, when the pedal for crushing work is operated, hydraulic fluid is supplied to the reverse port first, then the hydraulic fluid is supplied to the forward port.

9. The jaw crusher according to claim 8, wherein the hydraulic circuit includes a hydraulic pilot switching valve switching flow of the hydraulic fluid between flow to the forward port and flow to the reverse port, and wherein, when the pedal for crushing work is operated, the switching valve supplies the hydraulic fluid to the reverse port first, and then switches to the flow to the forward port when a pressure of the hydraulic fluid reaches a predetermined pressure.

* * * * *